US006087634A

United States Patent [19]

Cook et al.

[11] Patent Number: 6,087,634

[45] Date of Patent: Jul. 11, 2000

[54] BROWNING GRILL FOR HIGH POWER DENSITY RADIANT OVENS

[75] Inventors: Edward R. Cook, Cedarapids, Iowa; J. Scott Petty, Englewood, Colo.

[73] Assignee: Amana Company, L.P., Amana, Iowa

[21] Appl. No.: 08/994,922

[22] Filed: Dec. 19, 1997

[51] Int. Cl.[7] ..... A47J 37/00; A47J 37/06

[52] U.S. Cl. ..... 219/396; 219/411; 219/392; 219/399; 99/445; 99/446; 99/447

[58] Field of Search ..... 219/685, 719, 219/405, 461.1, 411, 396, 391–392, 399; 392/416, 418, 433; 99/451, 401, 447, 444–450; 126/25 R, 41 R, 299 R

[56] References Cited

U.S. PATENT DOCUMENTS

| | | | |
|---|---|---|---|
| 1,517,161 | 11/1924 | Kershaw | 99/444 |
| 1,591,291 | 7/1926 | Detwiler | 99/444 |
| 1,899,682 | 2/1933 | Goldenberg | 99/444 |
| 3,443,510 | 5/1969 | Norton | 99/445 |
| 3,463,139 | 8/1969 | Hayashi et al. | 99/446 |
| 3,745,912 | 7/1973 | Field . | |
| 4,378,729 | 4/1983 | Pierick . | |
| 4,508,097 | 4/1985 | Berg | 126/41 |
| 4,762,059 | 8/1988 | McLane, Sr. | 99/445 |
| 4,771,154 | 9/1988 | Bell et al. | 219/405 |
| 5,045,660 | 9/1991 | Levinson | 219/10.55 |
| 5,105,725 | 4/1992 | Haglund | 99/446 |
| 5,121,738 | 6/1992 | Harris . | |
| 5,211,105 | 5/1993 | Liu | 99/446 |
| 5,259,299 | 11/1993 | Ferraro . | |
| 5,367,951 | 11/1994 | Purvis | 99/446 |
| 5,517,005 | 5/1996 | Westerberg et al. | 219/685 |
| 5,649,477 | 7/1997 | Lingwood | 99/446 |
| 5,721,805 | 2/1998 | Cook et al. | 392/411 |
| 5,755,154 | 5/1998 | Schroeter et al. | 99/401 |

*Primary Examiner*—John A. Jeffery
*Attorney, Agent, or Firm*—Tobor, Goldstein & Healey; Ben D. Tobor; Clarence E. Eriksen

[57] ABSTRACT

A browning grill is arranged for use in a high power density radiant oven. The oven includes a cooking enclosure having a ceiling and a floor, upper radiant energy sources located near the ceiling, and lower radiant energy sources located near the floor. The browning grill has a grilling surface and a debris collector. The grilling surface has a plurality of grill tines. The grilling surface is located between the upper and lower radiant energy sources, and the grilling surface establishes a cooking plane to the upper radiant energy sources. The debris collector catches food debris from food being grilled on the grilling surface. The debris collector is located between the grilling surface and the lower radiant energy sources, and the debris collector is arranged to permit heating of the cooking plane by the lower radiant energy sources.

9 Claims, 9 Drawing Sheets

BROWNING GRILL FOR HIGH POWER DENSITY RADIANT OVENS

TECHNICAL FIELD OF THE INVENTION

The present invention is directed to a browning grill for a high power density radiant oven.

BACKGROUND OF THE INVENTION

A high power density radiant energy oven typically has upper radiant energy sources above the cooking plane and lower radiant energy sources below the cooking surface of the oven. The radiant energy sources, for example, may be tungsten-halogen lamps whose filaments operate at temperatures in the range of 2000–3200 Kelvin. The upper and lower radiant energy sources are protected by corresponding upper and lower shields, which may be in the form of glass ceramic panels. The upper shield protects the upper radiant energy sources from spatters, moisture, and other debris produced during the cooking process. The lower shield protects the lower radiant energy sources from spatters, moisture, and other debris as well as drips and run overs produced during the cooking process.

A grill may be used inside such an oven in order to grill foods such as meats, poultry, and fish products. A grill usually has a plurality of spaced apart grill tines which define a grilling surface on which food is cooked and which, when heated, produce a grilled appearance on the food being cooked. However, conventional grills are either not arranged to permit the lower radiant energy sources to cook the food on the grill, or they allow grease, moisture, and other food debris to fall through the spaces between the grill tines to the lower shield protecting the lower radiant energy sources.

When food debris falls on the lower shield, the food debris receives a higher degree of radiant energy than does food at the cooking surface. Consequently, the food debris on the lower shield tends to burn, thereby producing smoke, odor, and staining of the glass panel, all of which are objectionable to the user of the oven. In addition, if the stains are not cleansed but are instead allowed to build up on the lower shield, the stains steadily degrade the output power produced by the lower radiant energy sources. This degradation of the output power produced by the lower radiant energy sources adversely impacts the performance of the oven.

The present invention is intended to solve one or more of the above noted problems.

SUMMARY OF THE INVENTION

According to a first aspect of the present invention, a browning grill for a high power density radiant oven comprises a grilling surface and a debris collector. The grilling surface has a plurality of grill tines. The debris collector cooperates with the grilling surface to catch food debris from food being grilled on the grilling surface.

According to another aspect of the present invention, a browning grill for a high power density radiant oven comprises a grilling surface and a debris collector. The grilling surface has a plurality of grill tines. The debris collector cooperates with the grilling surface to catch food debris from food being grilled on the grilling surface, and the debris collector comprises a wall and a well. The well is configured to catch food debris from the grilling surface. The wall is arranged to produce heat from absorption of radiant energy, and the wall is arranged to conduct the heat to the grilling surface. The well is arranged to produce little heat from absorption of radiant energy.

According to yet another aspect of the present invention, a browning grill for a high power density radiant oven comprises a grilling surface and a debris collector. The grilling surface has a plurality of grill tines. The grilling surface establishes a cooking plane to upper radiant energy sources located above the grilling surface. The debris collector cooperates with the grilling surface to catch food debris from food being grilled on the grilling surface, and the debris collector is arranged to permit heating of the cooking plane by lower radiant energy sources located below the grilling surface.

According to a further aspect of the present invention, a high power density radiant oven comprises a cooking enclosure, upper and lower radiant energy sources, a grilling surface, and a debris collector. The cooking enclosure has a ceiling and a floor. The upper radiant energy sources are located near the ceiling, and the lower radiant energy sources are located near the floor. The grilling surface has a plurality of grill tines, the grilling surface is located between the upper and lower radiant energy sources, and the grilling surface establishes a cooking plane to the upper radiant energy sources. The debris collector cooperates with the grilling surface to catch food debris from food being grilled on the grilling surface, the debris collector is located between the grilling surface and the lower radiant energy sources, and the debris collector is arranged to permit heating of the cooking plane by the lower radiant energy sources.

According to a still further aspect of the present invention, a browning grill for a high power density radiant oven comprises a grilling surface and a debris collector. The grilling surface has plurality of grill tines and channels between the grill tines. The channels are sloped. The grilling surface, with its grill tines and channels, is formed of a stamped metal. The debris collector cooperates with the sloped channels so as to catch food debris from food being grilled on the grilling surface.

According to a yet further aspect of the present invention, a browning grill comprises a corrugated grilling surface, and a generally ring-shaped debris collector cooperating with the corrugated grilling surface so as to catch food debris from food being grilled on the corrugated grilling surface.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
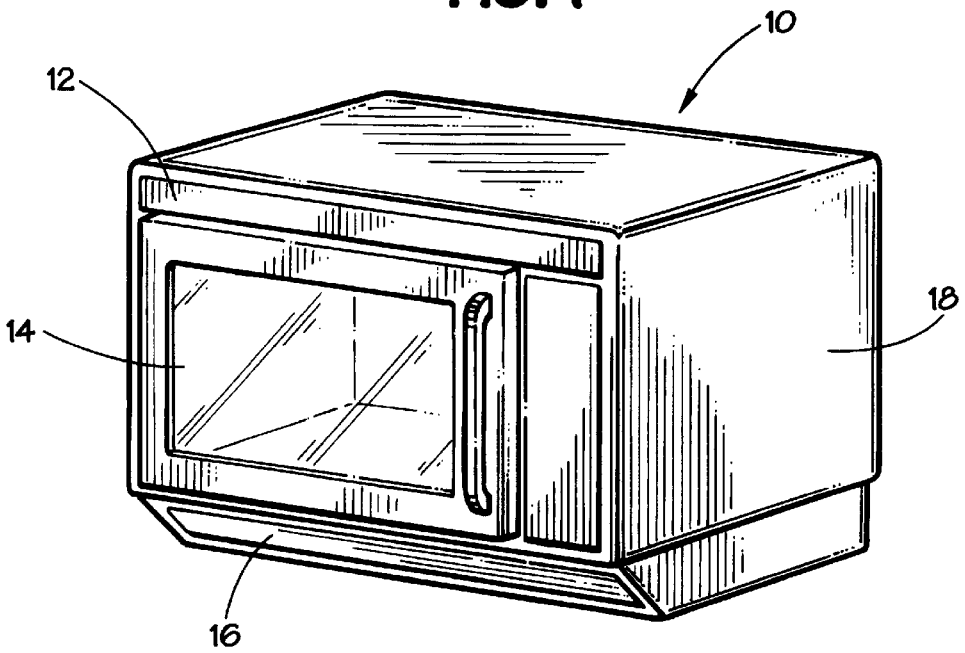
FIG. 1 is an isometric view of an oven in which the browning grill of the present invention may be used.

An oven 10 is illustrated in FIG. 1 and includes an upper high energy source module 12, a door 14, and a lower high energy source module 16. The upper high energy source module 12 and the lower high energy source module 16 are housed in a cabinet 18 of the oven 10. The cabinet 18 defines a cooking chamber of the oven 10, and the door 14 provides access to the cooking chamber defined by the cabinet 18. If desired, the oven 10 may be provided with an air intake and exhaust (not shown) in order to distribute air through the oven 10.

Figure 2:
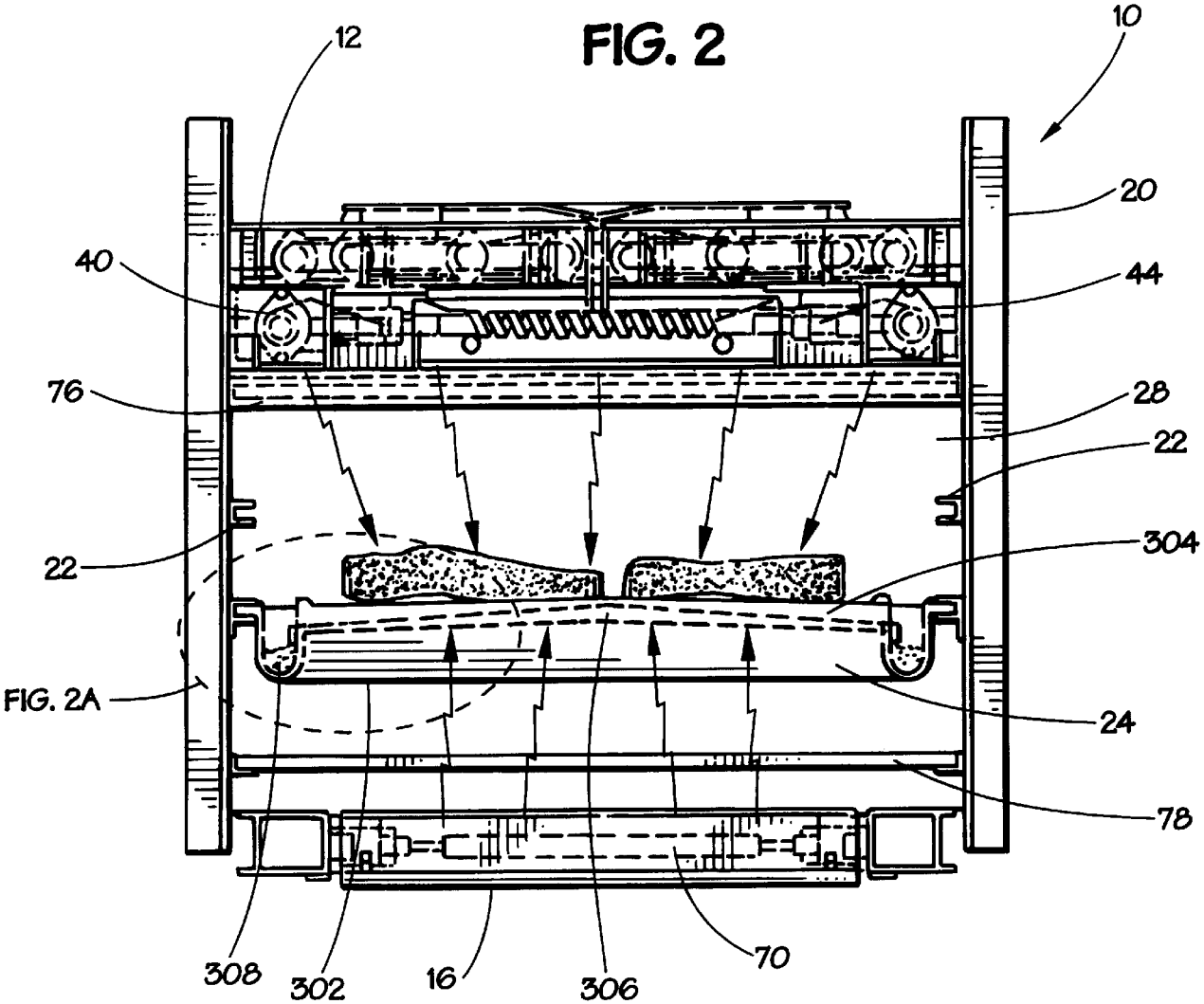
FIG. 2 is a front view of a frame which may be used in the oven illustrated in FIG. 1 and which supports a browning grill according to the present invention.
Figure 3:
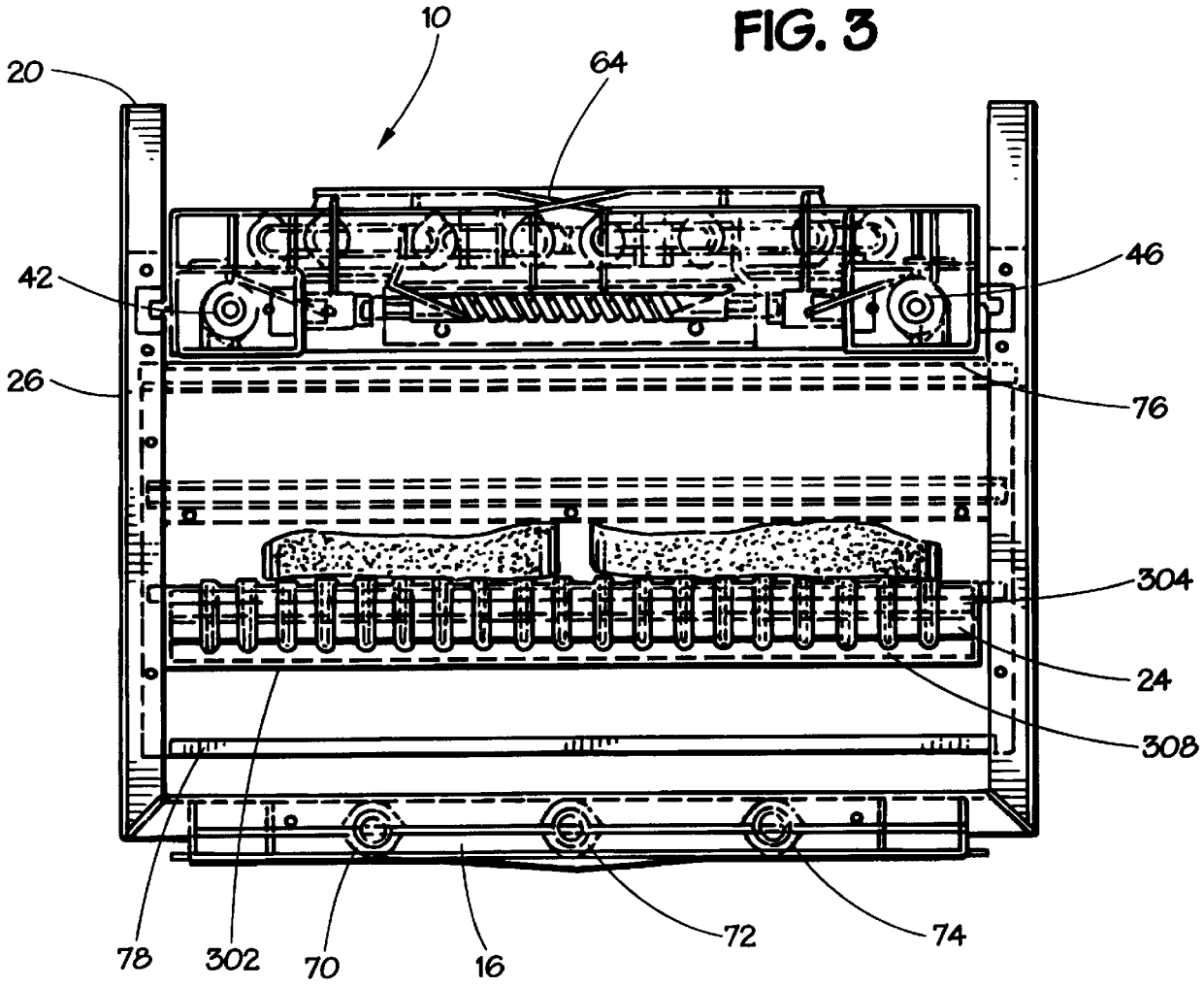
FIG. 3 is a side view of the frame illustrated in FIG. 1.

As illustrated in FIGS. 2 and 3, the oven 10 has a frame 20 which is housed by the cabinet 18 of the oven 10 and which supports the upper high energy source module 12 and the lower high energy source module 16. The frame 20 also has support rack guides 22 which are arranged to support various devices, such as a browning grill 24, within the oven 10. The browning grill 24 may take the form of the browning grill shown in FIG. 7. However, the browning grill 24 may alternatively take like forms such as the browning grills shown in FIGS. 5 and 6.

An opening 26 through one side of the frame 20 cooperates with the door 14 in order to permit access to a cooking area 28 within the oven 10. Accordingly, the browning grill 24, or other cooking trays, may be inserted through the opening 26 and supported by the support rack guides 22.

Figure 4:
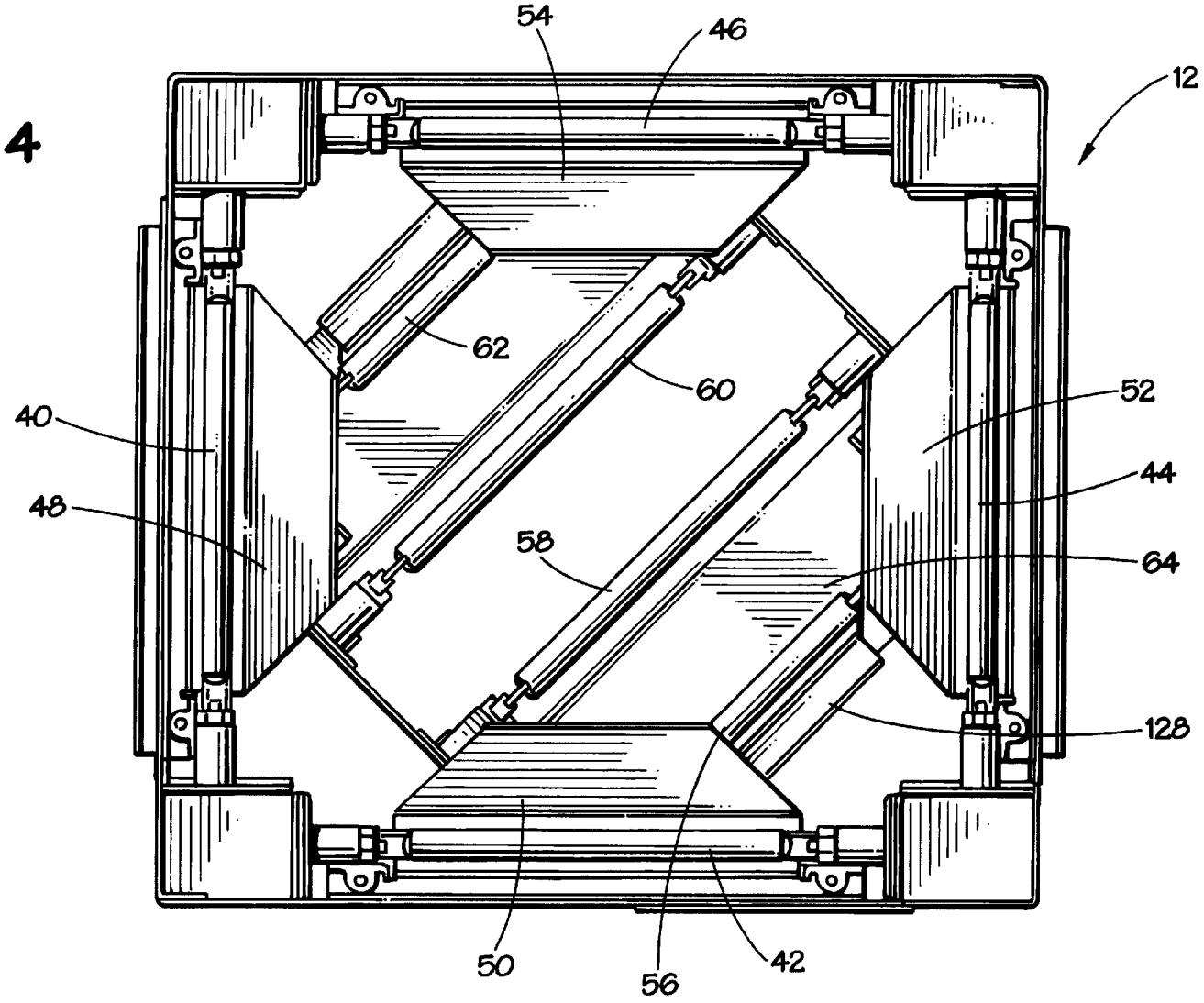
FIG. 4 is a bottom view of an upper high energy source module supported by the frame illustrated in FIG. 1.

The upper high energy source module 12 is illustrated in FIG. 4 and comprises radiant energy sources 40, 42, 44, and 46 which may be in the form of tungsten-halogen heating lamps. As illustrated in FIG. 4, each of the radiant energy sources 40–46 is parallel to a corresponding side of the upper high energy source module 12. Behind each of the radiant energy sources 40, 42, 44, and 46 is a corresponding reflector 48, 50, 52, and 54. These reflectors 48–54 are arranged to reflect radiant energy to the grilling surface of the browning grill 24. The upper high energy source module 12 also includes radiant energy sources 56, 58, 60, and 62 which extend diagonally across the upper high energy source module 12. Behind the radiant energy sources 56, 58, 60, and 62 is a formed reflector 64 which is arranged to reflect radiant energy from the radiant energy sources 56, 58, 60, and 62 to the grilling surface of the browning grill 24. The upper high energy source module 12 is supported by the frame 20 so that radiant energy from the radiant energy sources 40–46 and 56–62 directly impinges on the cooking surface of the browning grill 24 and also impinges on this cooking surface indirectly through reflection by the reflectors 48–54 and 64.

Additional features of the upper high energy source module 12 are disclosed in U.S. Pat. No. 5,721,805.

As shown in FIGS. 2 and 3, the lower high energy source module 16 includes a plurality of radiant energy sources 70, 72 and 74, which may be in the form of tungsten-halogen heating lamps and which are arranged to emit radiant energy to the underside of the browning grill 24.

An upper shield 76 protects the upper high energy source module 12 and a lower shield 78 protects the lower high energy source module 16 from food debris produced during the process of cooking food on the browning grill 24.

Figure 5:
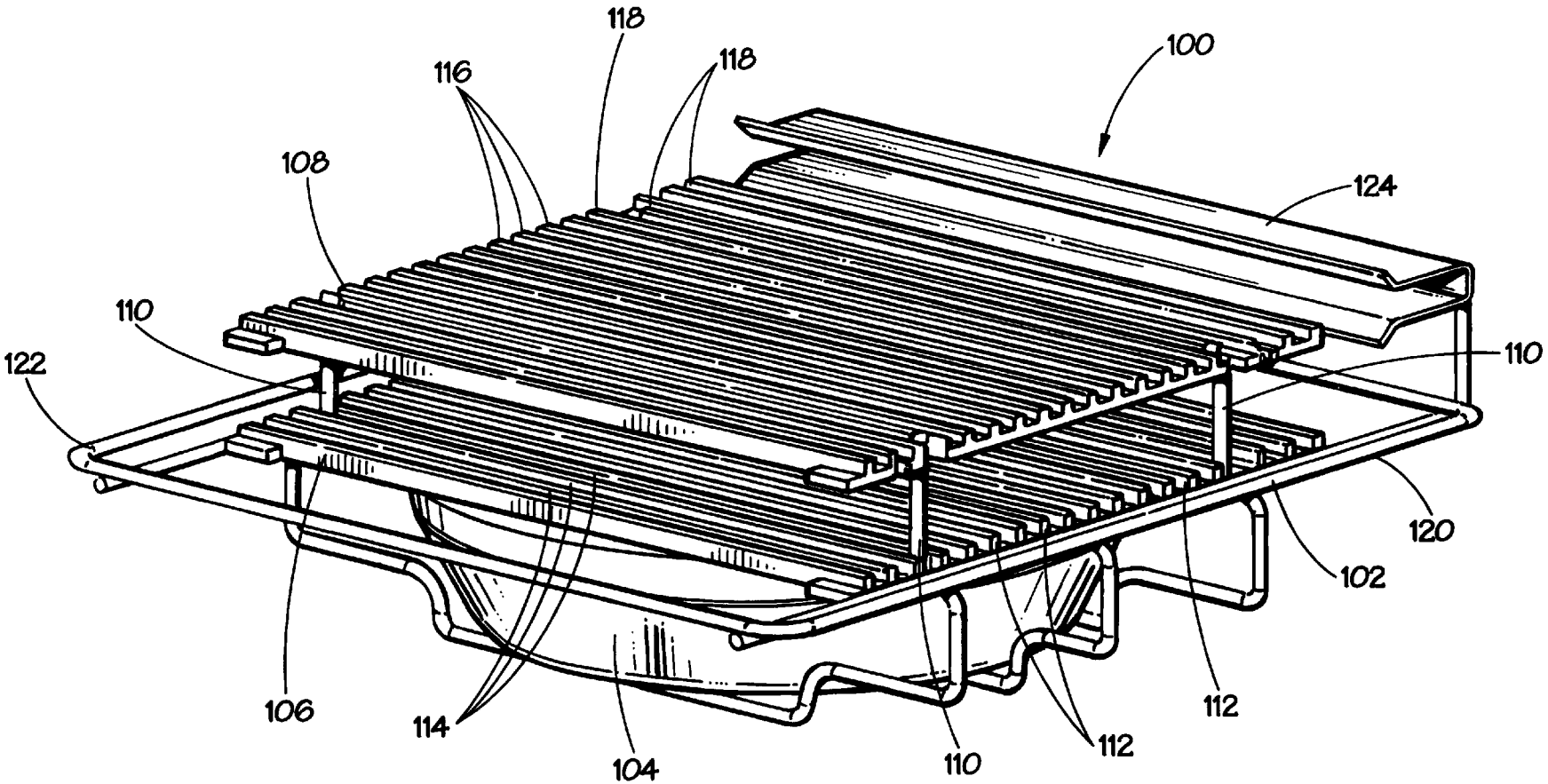
FIG. 5 is an isometric view of a browning grill according to a first embodiment of the present invention.

A first embodiment of a browning grill 100 is illustrated in FIG. 5. The browning grill 100 includes a support frame 102 which supports a debris collector 104. The debris collector 104 may be transparent and is arranged to collect food debris before this food debris soils the lower shield 78. A pair of grilling surfaces 106 and 108 is also supported by the support frame 102. Specifically, the grilling surface 106 is supported directly by the support frame 102, and the grilling surface 106 is supported indirectly by the support frame 102 through the use of standoffs 110 which support the grilling surface 108 above the grilling surface 106 and which are suitably fastened to the support frame 102. If desired, the grilling surface 108 may be removable.

The grilling surface 106 includes a plurality of grill tines 112 on which food is cooked within the oven 10. A plurality of channels 114 are provided between the grill tines 112. The channels 114 may have openings or gaps which are configured according to the geometry of the debris collector 104 so that food debris, produced during the process of cooking on the grill tines 112, passes through the channels 114 and is collected by the debris collector 104. Accordingly, the debris collector 104 acts to catch grease, moisture, and other types of food debris produced during the cooking process.

The grilling surface 108 likewise includes a plurality of grill tines 116 on which food is cooked within the oven 10. A plurality of channels 118 are provided between the grill tines 116. The channels 118 may have openings or gaps which are configured according to the geometry of the debris collector 104 so that food debris, produced during the process of cooking on the grill tines 116, passes through the channels 118, through the channels 114 between the grill tines 112, and is collected by the debris collector 104. The grill tines 112 and 116 may be treated with a non-stick material so that foods grilled by the browning grill 100 do not stick thereto.

The support frame 102 has runners 120 and 122 which interact with the support rack guides 22 so that the browning grill 100 may be supported by the frame 20 between the upper high energy source module 12 and the lower high energy source module 16. A support bracket 124 may be provided as an alternative support for the grilling surface 108.

When the browning grill 100 is inserted into the oven 10 so that it is supported by the support rack guides 22, and when food to be cooked is placed on the grill tines 116 of the browning grill 100, radiant energy from the upper high energy source module 12 impinges directly on the food to heat and thereby cook the food. In addition, radiant energy emitted by the upper high energy source module 12 is absorbed by the browning grill 100. Also, radiant energy from the lower high energy source module 16 passes through the debris collector 104 to impinge upon the browning grill 100. The browning grill 100 absorbs the radiant energy emitted by the lower higher energy source module 16. The radiant energy absorbed by the browning grill 100 from the upper and lower high energy source modules 12 and 16 thereby creates heat. This heat is conducted by the browning grill 100, and by the air surrounding the browning grill 100, to the grill tines 116 in order to also cook the food.

When food to be cooked is placed on the grill tines 112 of the browning grill 100, the grilling surface 108 may be removed. Accordingly, radiant energy from the upper high energy source module 12 impinges directly on the food to thereby heat and cook the food. In addition, radiant energy from the upper high energy source module 12 is absorbed by the browning grill 100. Also, radiant energy from the lower high energy source module 16 passes through the debris collector 104 to impinge upon the browning grill 100. The browning grill 100 absorbs the radiant energy emitted by the lower high energy source module 16. The radiant energy absorbed by the browning grill 100 from the upper and lower high energy source modules 12 and 16 thereby creates heat. This heat is conducted by the browning grill 100, and by the air surrounding the browning grill 100, in order to also cook the food.

When food to be cooked is placed on the grill tines 112 and on the grill tines 116 of the browning grill 100 at the same time, radiant energy from the upper high energy source module 12 impinges directly on the food on the grill tines 116 to thereby heat and cook this food. In addition, radiant energy from the upper high energy source module 12 is absorbed by the browning grill 100. Also, radiant energy from the lower high energy source module 16 passes through the debris collector 104 to impinge upon browning grill 100. The browning grill 100 absorbs the radiant energy emitted by the lower higher energy source module 16. The radiant energy absorbed by the browning grill 100 from the upper and lower high energy source modules 12 and 16 thereby create heat. This heat is conducted by the browning grill 100, and by the air surrounding the browning grill 100, in order to also cook the food on the grill tines 112 and 116.

Instead of being transparent, the debris collector 104 may alternatively be metal having a bottom surface coated to enhance radiant energy absorption. Accordingly, the radiant energy emitted by the lower high energy source module 16 is absorbed by the bottom surface of the debris collector 104 thereby creating heat which is conducted by the debris collector 104, by the browning grill 100, and by the air surrounding the debris collector 104 and the browning grill 100, in order to cook the food being grilled on the grilling surface 106 and/or on the grilling surface 108.

Figure 6:
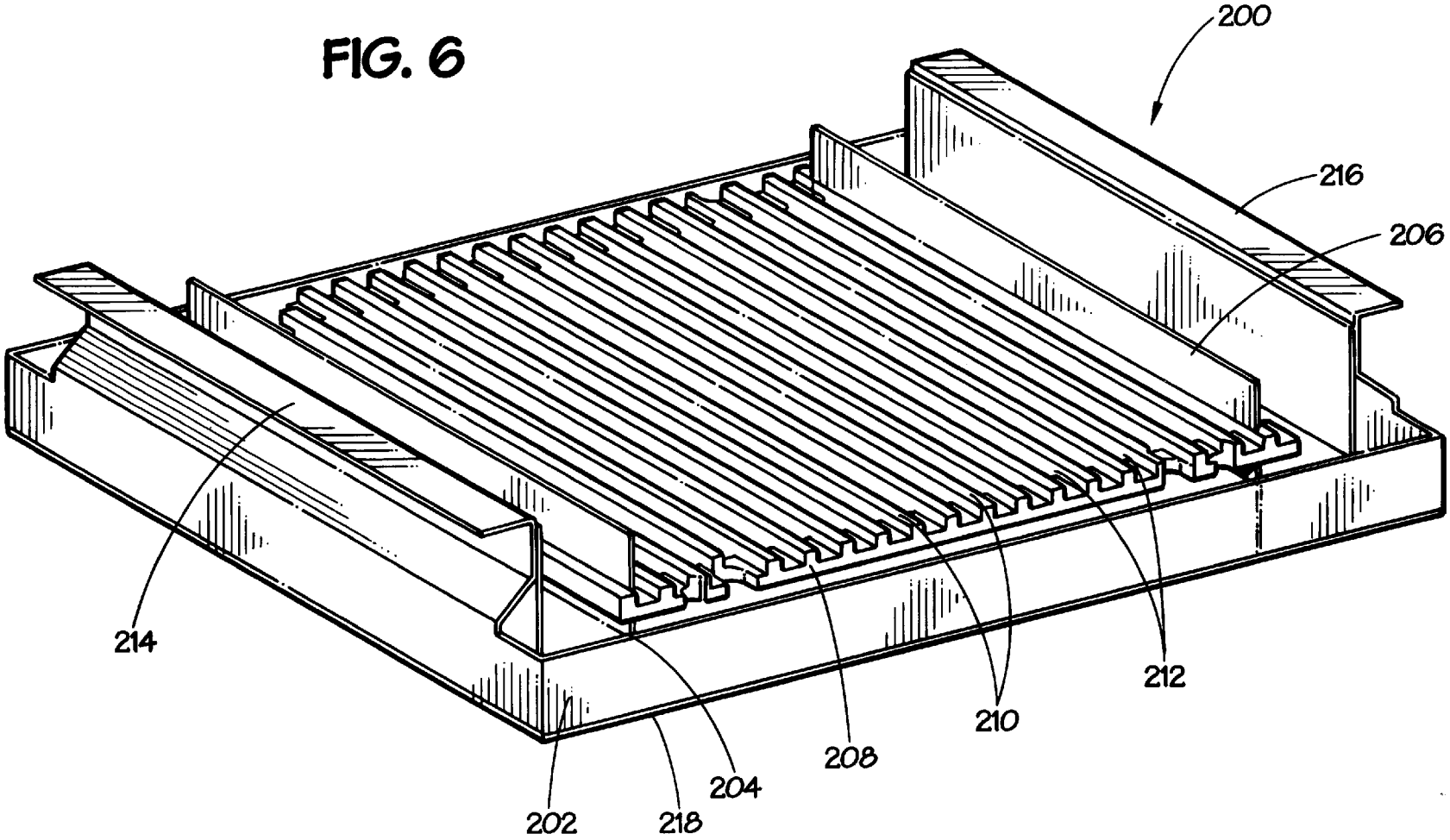
FIG. 6 is an isometric view of a browning grill according to a second embodiment of the present invention.

A second embodiment of a browning grill 200 is illustrated in FIG. 6. The browning grill 200 includes an outer frame 202 which supports a debris collector 204 and an inner frame 206. The debris collector 204 may be transparent to the radiant energy emitted by the lower high energy source module 16, and the outer frame 202 may have a bottom which is open enough to allow radiant energy from the lower high energy source module 16 to pass through the debris collector 204 and to a grilling surface 208 supported by the inner frame 206. The debris collector 204 collect food debris produced during the cooking process. The grilling surface 208 includes a plurality of grill tines 210 defining a plurality of channels 212 therebetween. The channels 212 may have gaps or openings therethrough which extend along the better part of the channels 212 and which permit food debris produced by the cooking process to fall through the grilling surface 208 and to be collected by the debris collector 204.

The outer frame 202 has a pair of flanges 214 and 216 which are arranged to cooperate with the support rack guides 22 of the oven 10 in order to support the browning grill 200 within the oven 10. The grill tines 210 may be treated with a non-stick material so that foods grilled by the browning grill 200 do not stick thereto.

When the browning grill 200 is inserted into the oven 10 so that the grilling surface 208 can be used to grill food therein, radiant energy from the upper high energy source module 12 impinges directly on the food located on the grill tines 210 of the grilling surface 208 to thereby heat and cook the food. In addition, radiant energy from the upper high energy source module 12 is absorbed by the browning grill 200. Also, radiant energy from the lower high energy source module 16 passes through the debris collector 204. Part of this radiant energy passes through the openings of the channels 212 to directly heat the food being cooked, and part of this radiant energy is absorbed by the browning grill 200. The radiant energy absorbed by the browning grill 200 from the upper and lower high energy source modules 12 and 16 thereby creates heat which is conducted by the browning grill 200, and by the air surrounding the browning grill 200, in order to cook the food on the grilling surface 208.

Alternatively, the outer frame 202 may be a water tight outer frame which supports the inner frame 206 and the grilling surface 208 and which itself acts as a debris collector. In this case, the outer frame 202 has a bottom surface 218 which may also be provided with a non-stick material. Accordingly, the outer frame 202 may be turned over so that the bottom surface 218 faces the upper high energy source module 12 and may be used as a flat cooking surface within the oven 10. When the browning grill 200 is inserted into the oven 10 so that the bottom surface 218 can be used to cook food, radiant energy from the upper high energy source module 12 impinges directly on the food located on the bottom surface 218 of the browning grill 200 to thereby heat and cook the food. In addition, radiant energy from the upper high energy source module 12 is absorbed by the browning grill 200. Also, radiant energy from the lower high energy source module 16 is absorbed by the browning grill 200. The absorption of radiant energy by the browning grill 200 from the upper and lower high energy source modules 12 and 16 creates heat which is conducted by the browning grill 200, and by the air surrounding the browning grill 200, in order to cook the food on the bottom surface 218.

Figure 7:
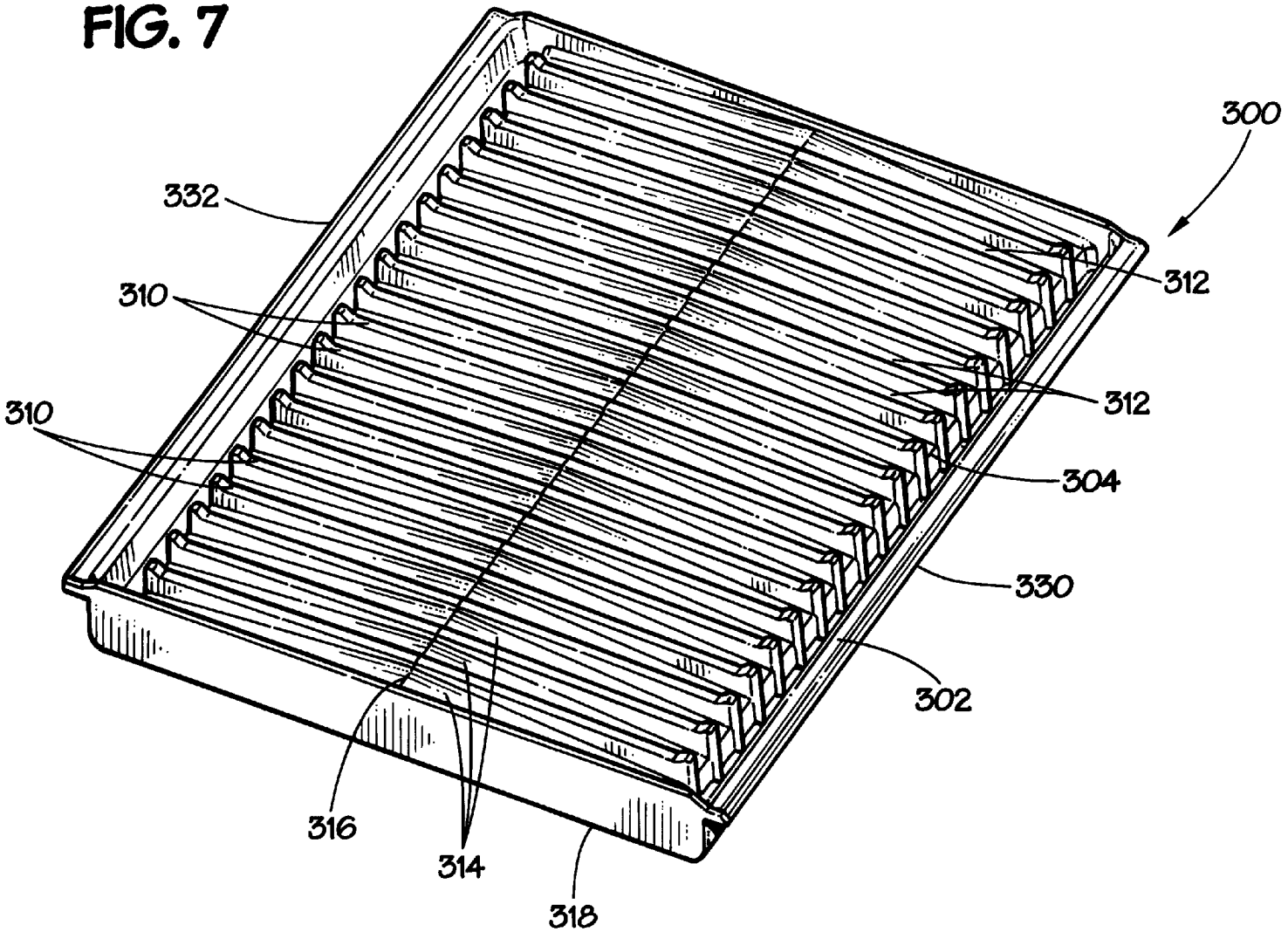
FIG. 7 is an isometric view of a browning grill according to a third embodiment of the present invention.

A third embodiment of a browning grill 300 (the embodiment shown in FIGS. 2 and 3) is illustrated in FIG. 7. The browning grill 300 includes a debris collector 302 on which a grilling surface 304 rests. As shown in FIGS. 2 and 3, the debris collector 302 may have a wall 306 in which a well 308 is formed around a perimeter thereof. The well 308 is arranged to collect food debris produced during the cooking process. The grilling surface 304 includes a plurality of grill tines 310 which are generally straight and horizontal across the grilling surface 304. Between the grill tines 310 are a plurality of channels 312 which have corresponding channel surfaces 314. The channel surfaces 314 are sloped away from a center line 316 so that the food debris which is produced by food cooking on the grill tines 310 may be channeled to the well 308. The grill tines 310 and/or the channels 312 may be coated with a non-stick coating. For example, the non-stick coating may be supplied under the name Excalibur® by Whitford Products.

Figure 2A:
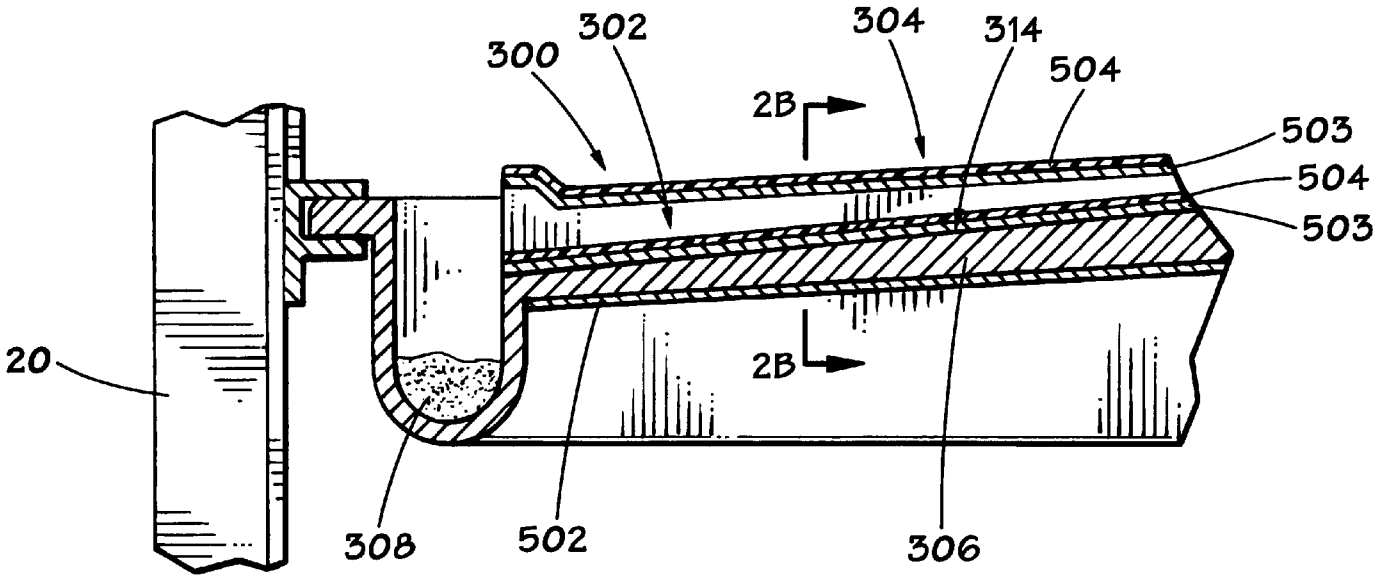
FIG. 2A is an enlarged fragmentary sectional view of the dotted portion designated 2A in FIG. 2.
Figure 2B:
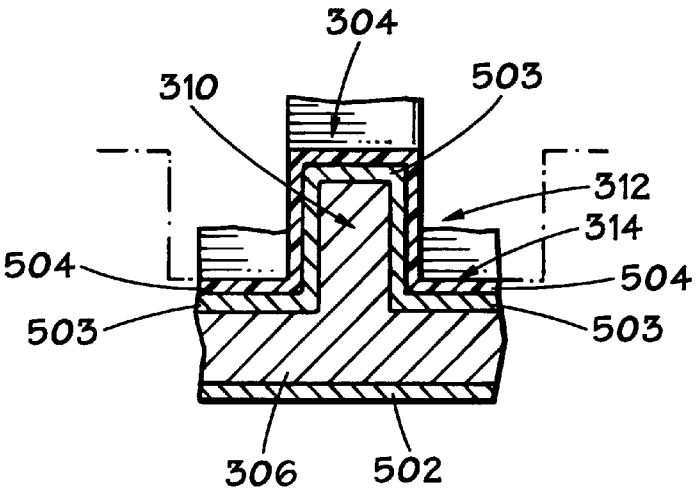
FIG. 2B is a fragmentary cross-sectional view along line 2B—2B of FIG. 2A.

The side of the wall 306 of the debris collector 302, which faces the lower high energy source module 16, may be coated with a high temperature black stove paint or equivalent material. Such a material is highly absorptive to the radiant energy emitted by the lower high energy source module 16. However, the underside of the well 308 is not likewise coated with the highly absorptive material. Accordingly, when the browning grill 300 is inserted into the oven 10 so that the grilling surface 304 can be used to grill food, radiant energy from the upper high energy source module 12 impinges directly on the food located on the grill tines 310 of the grilling surface 304 in order to heat and thereby cook the food. Also, radiant energy from the lower high energy source module 16 is absorbed by the highly absorptive material on the wall 306. The absorption of radiant energy by the browning grill 300 from the lower high energy source modules 16 creates heat which is conducted by the debris collector 302, and by the air surrounding the debris collector 302, in order to cook the food being grilled on the grill tines 310. The side of the wall 306 of the debris collector 302, which faces the lower high energy source module 16, may be alternatively coated with a black non-stick material (such as PTFE) if the surface is to be used as a cooking surface. Such a material is also highly absorptive to the radiant energy emitted by the lower high energy source module 16. With reference to FIGS. 2A and 2B, the heat absorptive material is indicated by the reference numerals 502 and 503, and the non-stick coating is indicated by the reference numeral 504.

However, as described above, the underside of the well 308 is not coated with the highly absorptive matter. Accordingly, if aluminum is used for the debris collector 302, for example, the bare aluminum of the underside of the well 308 tends to reflect radiant energy from the lower high energy source module 16, thus keeping the well 308 (which contains the food debris produced during cooking) relatively cooler than the wall 306 thereby reducing the likelihood that the food debris collected in the well 308 will burn, smoke, or boil over during cooking. Additionally, the material thickness of the well 308 may be tapered from the main grill surface in order to create a thermal choke. As a result, although thermal equalization will eventually occur, the sump area created by the well 308 remains significantly cooler for all practical purpose than the grill because of the speed of cooking.

The grilling surface 304 may be cast in 380 aluminum alloy from matched dies, or the grilling surface 304 may be sandcast from a machined model. Aluminum is corrosive resistant and possesses excellent thermal conduction properties.

Alternatively, the grilling surface 304 may be stamped using a relatively malleable metal. In addition, the grilling surface 304 may be stamped using a malleable and disposable metal. Accordingly, the grilling surface 304 may be discarded after its first use or after some limited number of uses.

Figure 8:
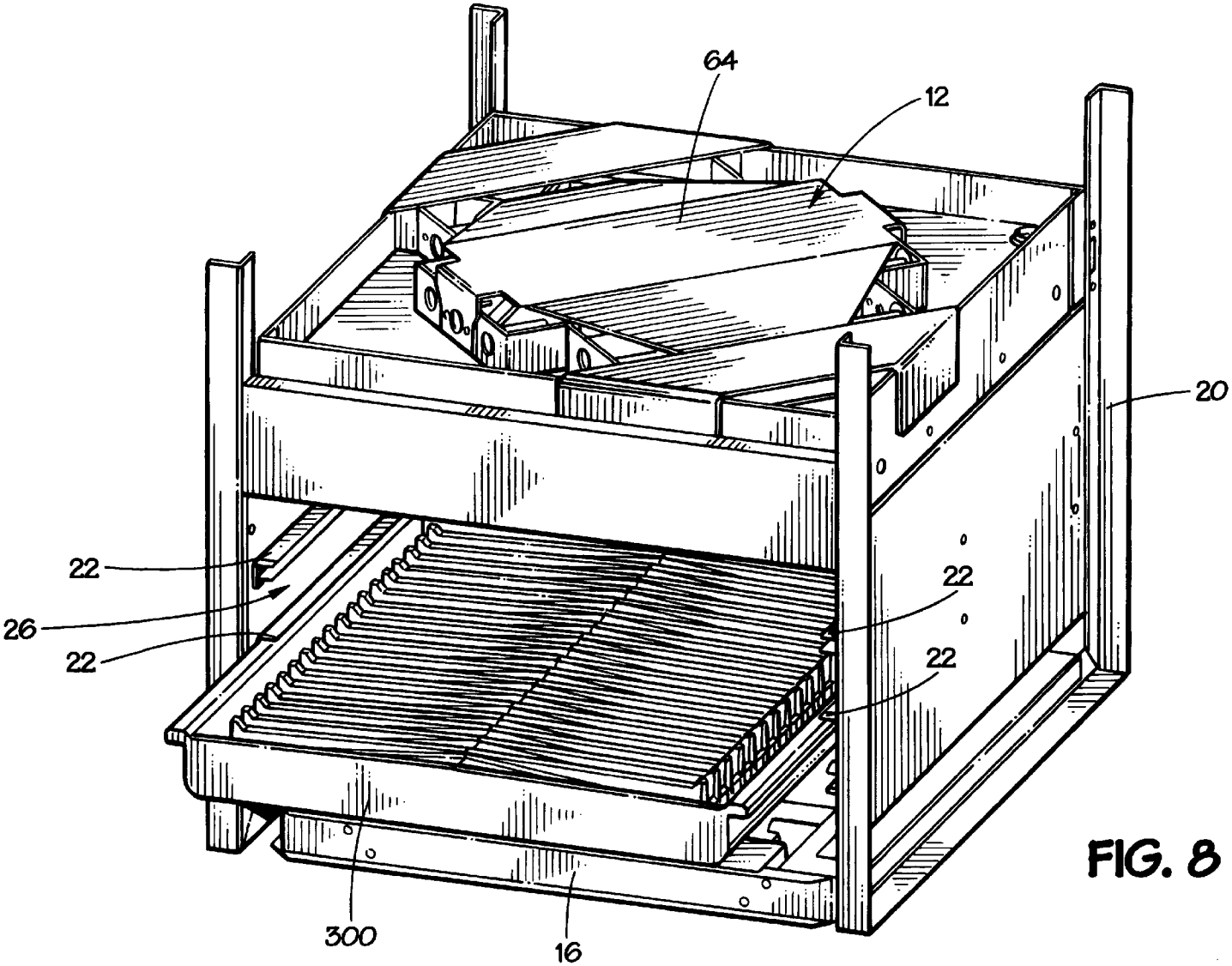
FIG. 8 is an isometric view of the browning grill illustrated in FIG. 7 supported by the frame illustrated in FIGS. 2 and 3; and, FIG. 9 is an isometric view of a browning grill according to a fourth embodiment of the present invention.

The browning grill 300 has flanges 330 and 332 which cooperate with the support rack guides 22 in order to support the browning grill 300 on the frame 20 of the oven 10, as shown in FIG. 8.

Figure 9:
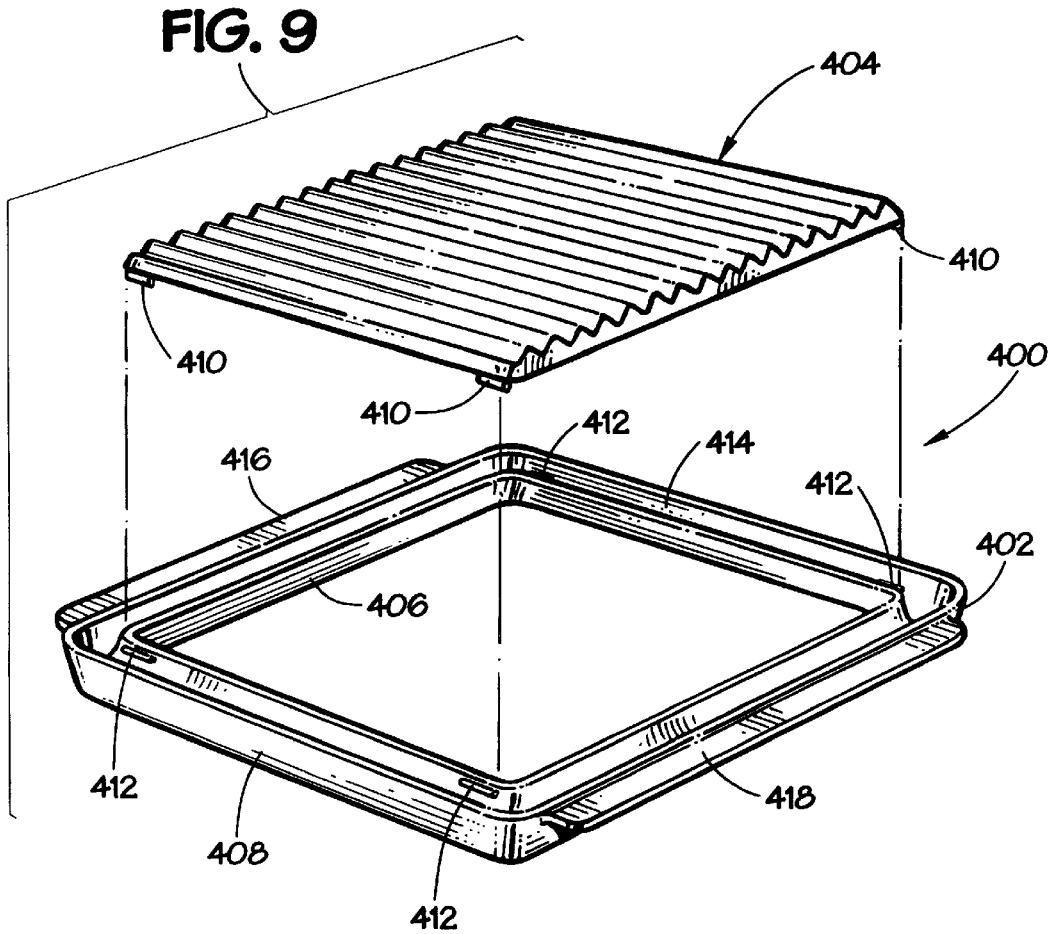

A browning grill 400 according to a fourth embodiment of the present invention is illustrated in FIG. 9. The browning grill 400 includes a debris collector 402 and a grilling surface 404. The grilling surface 404 has a tab 410 at each of its corners, and each tab 410 engages a corresponding ridge 412 in order to support the grilling surface 404 on the debris collector 402. Alternatively, the ridges 412 may be slots that receive the corresponding tabs 410 in order to support the grilling surface 404 on the debris collector 402. Preferably, the tabs 410 minimize the area of contact between the debris collector 402 and the grilling surface 404 in order to reduce thermal conduction from the grilling surface 404 to the debris collector 402.

The debris collector 402 is generally in the shape of a quadrilateral ring which is defined by an inner perimeter 406 and an outer perimeter 408 so that the debris collector 402 is open within the inner perimeter 406. The debris collector 402 has a well 414 between the inner perimeter 406 and the outer perimeter 408. The well 414 is arranged to collect food debris produced during the cooking process. The grilling surface 404 may be corrugated to facilitate the collection of debris and the channeling of the collected debris to the well 414. The browning grill 400 has flanges 416 and 418 which cooperate with support rack guides in an oven in order to support the browning grill 400 within the cooking chamber of the oven. These flanges 416 and 418 may also serve as handles for the browning grill 400.

The grilling surface 404, for example, may be a stamped steel grill that is coated on its top surface (i.e., its food supporting surface) with a black non-stick material (such as PTFE) and that is coated on its bottom surface with a black, high temperature primer. The inside of the well 414 (i.e., the sump that collects debris) of the debris collector 402 may be coated with PTFE, for example, and the remainder of the debris collector 402 may be untreated so as to reflect IR energy. The low mass of the browning grill 400 together with the high emissivity surfaces which absorb IR energy permit the grilling surface 404 to rapidly heat during cooking.

Certain modifications of the present invention have been discussed above. Other modifications will occur to those practicing in the art of the present invention. For example, the debris collector 104 shown in FIG. 5, the outer frame 202 shown in FIG. 6, and/or the debris collector 204 shown in FIG. 6, may be provided with wells similar to the well 308, or with a plurality of wells at the corners thereof, in order to collect food debris in the same manner that the well 308 of the browning grill 300 collects food debris. Also, the features specifically described in relation to the browning grill 100, 200, 300, or 400 may be used for any of the others of the browning grills 100, 200, 300, and 400 disclosed herein.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A browning grill for high power density radiant oven comprising:

a grilling surface having a plurality of grill tines and channels between the grill tines, the channels having openings to channel food debris downward; and a debris collector which is located under the grilling surface, which is transparent to radiant energy, and which catches food debris which is channeled downward when food is being grilled on the grilling surface, the debris collector comprising a wall and a well, wherein the wall is arranged to produce heat from absorption of radiant energy, and wherein the well is arranged to produce little heat from absorption of radiant energy.

2. A browning grill for a high power density radiant oven comprising:

a grilling surface having a plurality of grill tines and channels between the grill tines, the channels being sloped so as to channel food debris downward; and a debris collector which is located under the grilling surface to catch food debris when food is grilled on the grilling surface, wherein the debris collector comprises a wall and a well, wherein the well is configured to catch food debris from the grilling surface, wherein the wall is arranged to produce heat from absorption of radiant energy, wherein the wall is arranged to conduct the heat to the grilling surface, and wherein the well is arranged to produce little heat from absorption of radiant energy.

3. The browning grill of claim 2 wherein the channels have openings to the debris collector.

4. The browning grill of claim 3 wherein the debris collector is transparent to radiant energy.

5. The browning grill of claim 3 wherein the debris collector is transparent to radiant energy, and wherein the well is arranged to hold the food debris away from a path between a source of radiant energy and the grill tines.

6. The browning grill of claim 2 wherein the debris collector is transparent to radiant energy, and wherein the well is arranged to hold the food debris away from a path between a source of radiant energy and the grill tines.

7. A browning grill comprising:

a stamped metal corrugated grilling surface having first and second sides, wherein the first side is coated with a non-stick substance and wherein the second side is coated with a radiation absorbing substance; and a generally ring-shaped debris collector which surrounds the periphery of the corrugated grilling surface to catch food debris when food is grilled on the corrugated grilling surface.

8. The browning grill of claim 7 wherein the generally ring-shaped debris collector comprises a cast aluminum.

9. The browning grill of claim 7 wherein the corrugated grilling surface is supported by supports on the generally ring-shaped debris collector so as to minimize thermal conduction therebetween.

* * * * *